US009731864B2

(12) United States Patent
Turner

(10) Patent No.: US 9,731,864 B2
(45) Date of Patent: Aug. 15, 2017

(54) SHIPPING CONTAINER AND SAFETY CATCH THEREFOR

(71) Applicant: Macro Plastics, Inc., Fairfield, CA (US)

(72) Inventor: Todd T. Turner, Corydon, IN (US)

(73) Assignee: Macro Plastics, Inc., Fairfield, CA (US)

( * ) Notice: Subject to any disclaimer, the term of this patent is extended or adjusted under 35 U.S.C. 154(b) by 0 days.

(21) Appl. No.: 14/785,766

(22) PCT Filed: May 12, 2014

(86) PCT No.: PCT/US2014/037660

§ 371 (c)(1),
(2) Date: Oct. 20, 2015

(87) PCT Pub. No.: WO2014/186269

PCT Pub. Date: Nov. 20, 2014

(65) Prior Publication Data

US 2016/0083138 A1 Mar. 24, 2016

Related U.S. Application Data

(60) Provisional application No. 61/822,633, filed on May 13, 2013.

(51) Int. Cl.
*B65D 19/18* (2006.01)
*B65D 25/00* (2006.01)

(52) U.S. Cl.
CPC ..... *B65D 25/005* (2013.01); *B65D 19/18* (2013.01); *B65D 2519/009* (2013.01); *B65D 2519/00034* (2013.01); *B65D 2519/00069* (2013.01); *B65D 2519/00174* (2013.01); *B65D 2519/00333* (2013.01); *B65D 2519/00407* (2013.01); *B65D 2519/00422* (2013.01); *B65D 2519/00502* (2013.01); *B65D 2519/00587* (2013.01);
(Continued)

(58) Field of Classification Search
CPC B65D 25/005; B65D 19/18; B65D 2519/009; B65D 2519/00646; B65D 2519/00502
USPC ..... 206/386, 600
See application file for complete search history.

(56) References Cited

U.S. PATENT DOCUMENTS 5,094,356 A 3/1992 Miller
6,209,742 B1 4/2001 Overholt et al.
7,287,661 B2 10/2007 Knutsson et al.
(Continued)

FOREIGN PATENT DOCUMENTS

AU 672015 B2 9/1996
DE 102008004520 A1 6/2009
(Continued)

OTHER PUBLICATIONS

The United States Patent and Trademark Office; The International Search Report and Written Opinion of PCT/US2014/037660; Search Report and Written Opinion; Sep. 9, 2014; pp. 1-15; The United States Patent and Trademark Office; U.S.A.

*Primary Examiner* — Stephen Castellano
(74) *Attorney, Agent, or Firm* — Wyatt, Tarrant & Combs, LLP; Matthew A. Williams

(57) ABSTRACT

A safety catch for preventing a drop-down side door from separating from the sidewall of a shipping container in the case of a hinge failure and a shipping including at least one safety catch.

2 Claims, 11 Drawing Sheets

(52) U.S. Cl.
CPC ..... *B65D 2519/00646* (2013.01); *B65D 2519/00805* (2013.01)

(56) References Cited

U.S. PATENT DOCUMENTS

| | | | | |
|---|---|---|---|---|
| 8,066,143 | B2 | 11/2011 | Baltz et al. | |
| 2004/0238400 | A1* | 12/2004 | Knutsson ..... | B65D 11/1833 206/600 |
| 2006/0260976 | A1 | 11/2006 | Apps | |
| 2009/0044376 | A1 | 2/2009 | Nolan | |
| 2011/0215105 | A1 | 9/2011 | Dubois et al. | |

FOREIGN PATENT DOCUMENTS

| | | | |
|---|---|---|---|
| JP | 2006298430 | | 11/2006 |
| JP | 2010202272 | | 9/2010 |
| WO | 2012140941 | A1 | 10/2012 |

* cited by examiner

Detail D

SHIPPING CONTAINER AND SAFETY CATCH THEREFOR

CROSS-REFERENCE TO RELATED APPLICATIONS

This national stage patent application, filed under 35 U.S.C. 371, claims priority to PCT Patent Application Number PCT/US14/37660 filed on 12 May 2014, which claims priority to U.S. Provisional Patent Application No. 61/822,633 filed on 13 May 2013, which is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention generally relates to returnable shipping containers, and more specifically to returnable shipping containers having drop down doors to permit access to goods contained in such containers.

2. General Background of the Invention

For many years, industries dealing in bulk goods have utilized returnable containers. Such containers typically have one or more drop-down doors located in the sidewalls of the container to permit operators easy access to the interior of the container to load goods into or unload goods from the container. Such drop-down doors are typically hinged at the bottom and held in an upright position using a pair of latches located on the vertical sides of the door. Frequently the mating hinge knuckles are formed integrally with the container sidewall and the drop-down door. A hinge pin is then inserted to bear the load of the door and to establish the axis of rotation.

In practice, operators will frequently unlatch the door and then allow it to freely rotate to its open position. This practice can, however, lead to injuries to the Operator if the hinges are not properly installed or assembled or if the hinges fail. In such cases, the door can freely fall to the floor, possibly causing injury to the operator. Such issues may not be obvious to an operator in advance, however, because a door installed in its upright, closed position will typically rest on the sidewall and have a lip or similar feature along its bottom portion that impinges on the inside of the sidewall to assist in bearing the load of the goods loaded in the container. Thus, a hinge issue is unlikely to be noticed in a door that is latched in its upright position because the latches and the lip cooperate to keep the door in place.

Previous attempts to address this issue have involved the use of a flexible safety tether in an attempt to keep door 50 from falling freely to the floor. The use of tethers, however, creates other issues that are not conducive to an efficient and safe workplace. For example, if the tether is located on the inside of the container, it can become tangled in the goods. And if the tether hangs on the outside of a container, it can be become tangled with other containers, which can create a hazard, especially where containers are stacked on top of one another in tight stacks. The productivity of operators can also be impacted by tethers since such tethers can get in the way of operators as they load and unload containers.

What is needed then is a returnable bulk container with a mechanism to prevent a drop-down side door from separating from the container in the case of a hinge failure that does not involve the use of a tether.

SUMMARY OF THE INVENTION

The present invention relates to a reusable shipping container having a safety catch to keep a drop down door connected to said container if the door's hinges were to fail.

BRIEF DESCRIPTION OF THE DRAWINGS

For a further understanding of the nature, objects, and advantages of the present invention, reference should be had to the following detailed description, read in conjunction with the attached figures, wherein like reference numerals denote like elements.

DETAILED DESCRIPTION OF THE INVENTION

Figure 1:
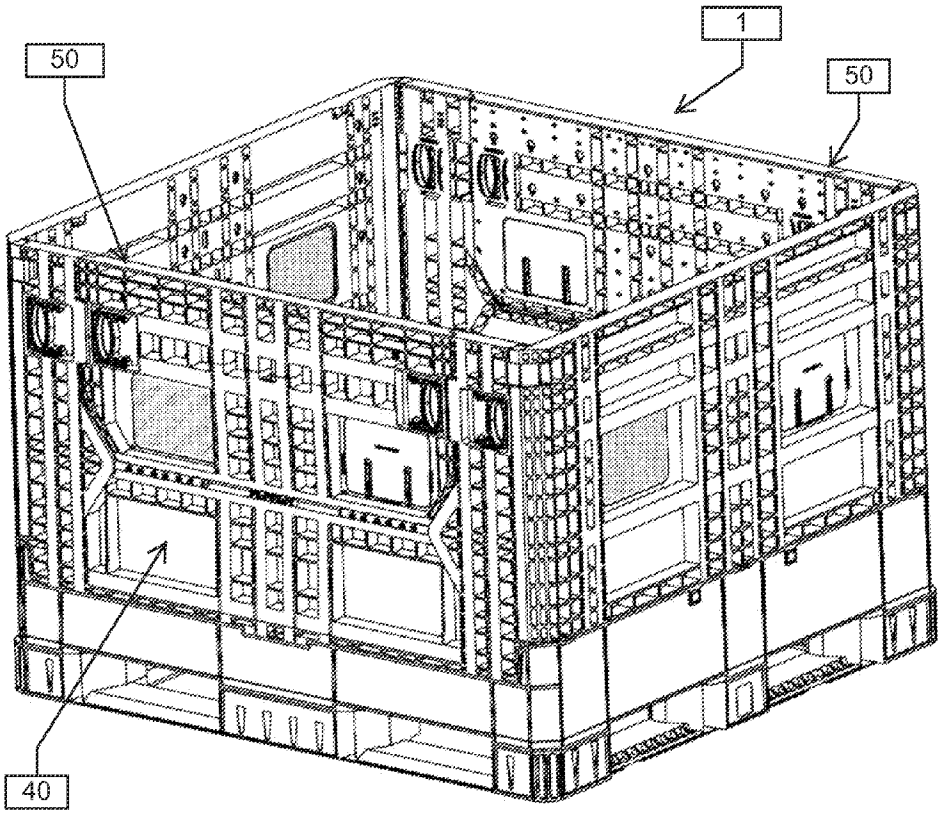
FIG. 1 is a perspective view of an embodiment of a shipping container with drop down doors and an embodiment of the safety catch.
Figure 2:
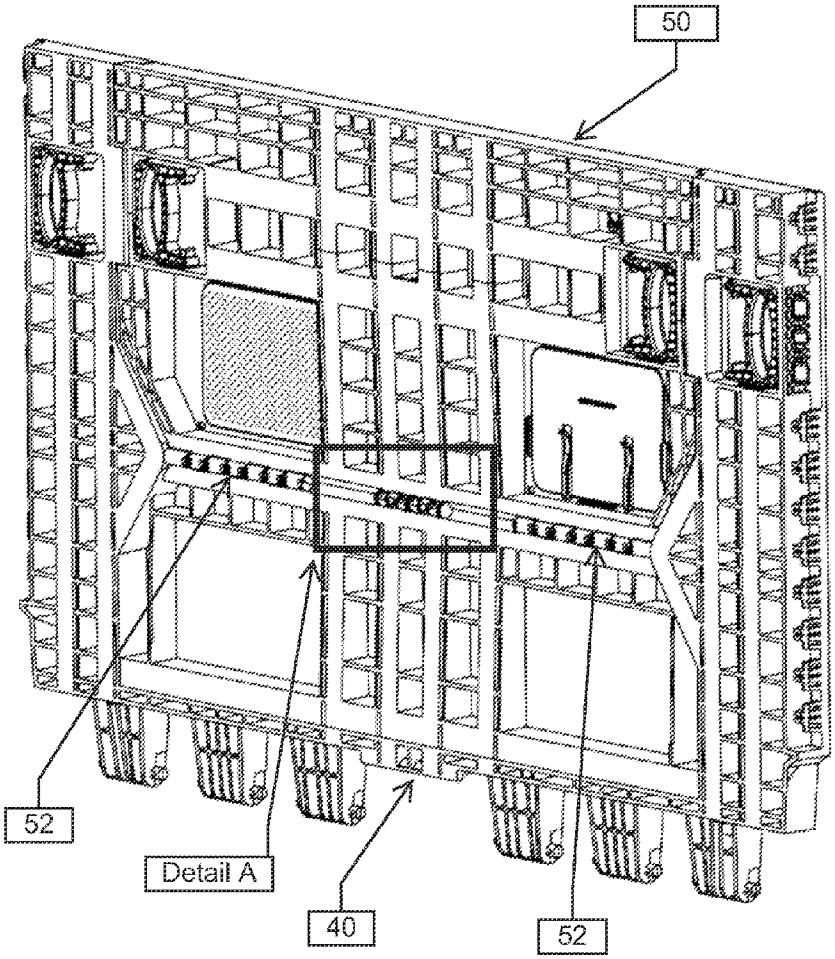
FIG. 2 is a perspective view of a sidewall from the embodiment shown in FIG. 1 including the drop down door in an upright position and the safety catch.
Figure 3:
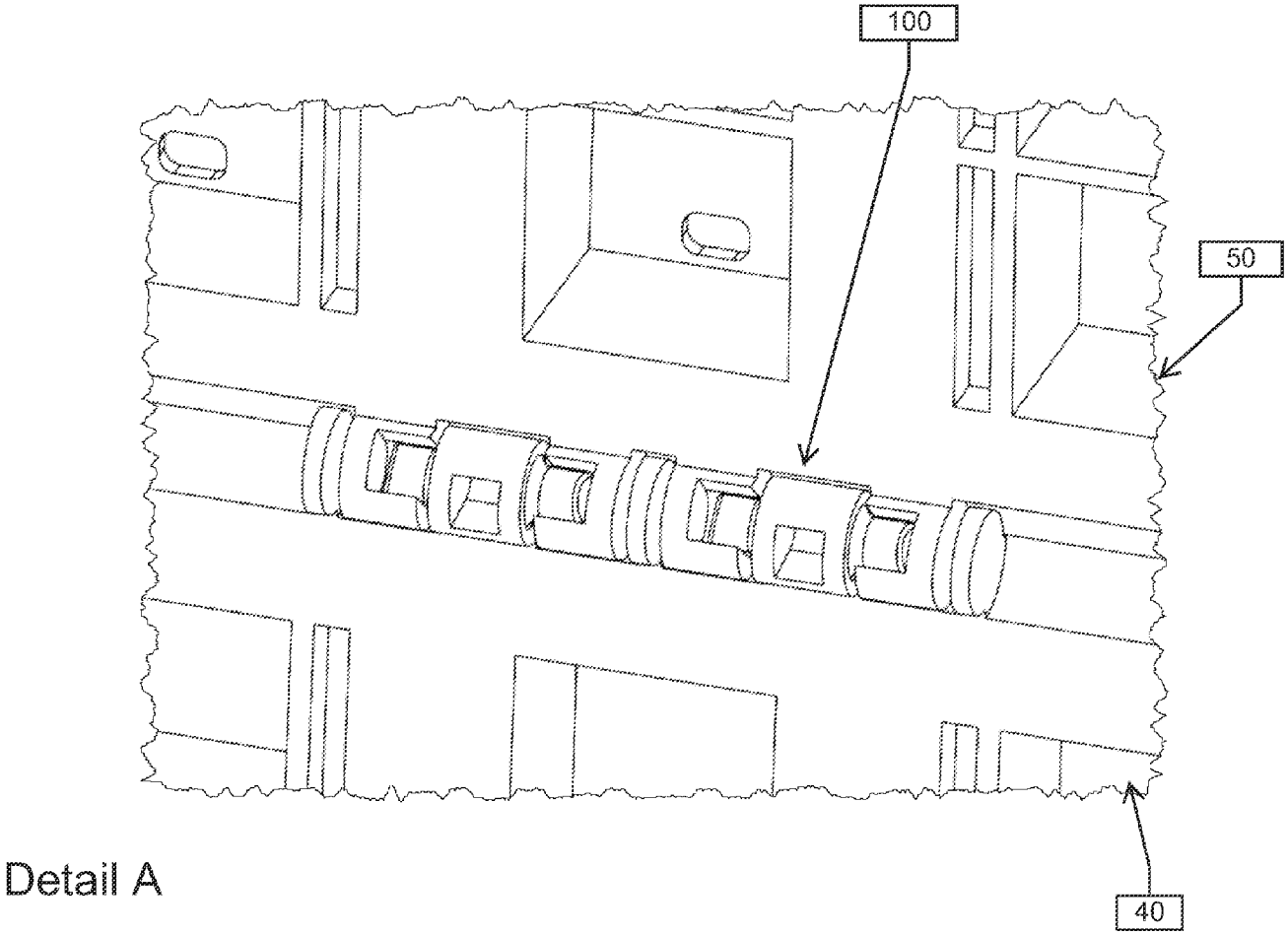
FIG. 3 is a detail perspective view of the embodiment from FIG. 2 showing the safety catch with the drop down door in an upright position.
Figure 4:
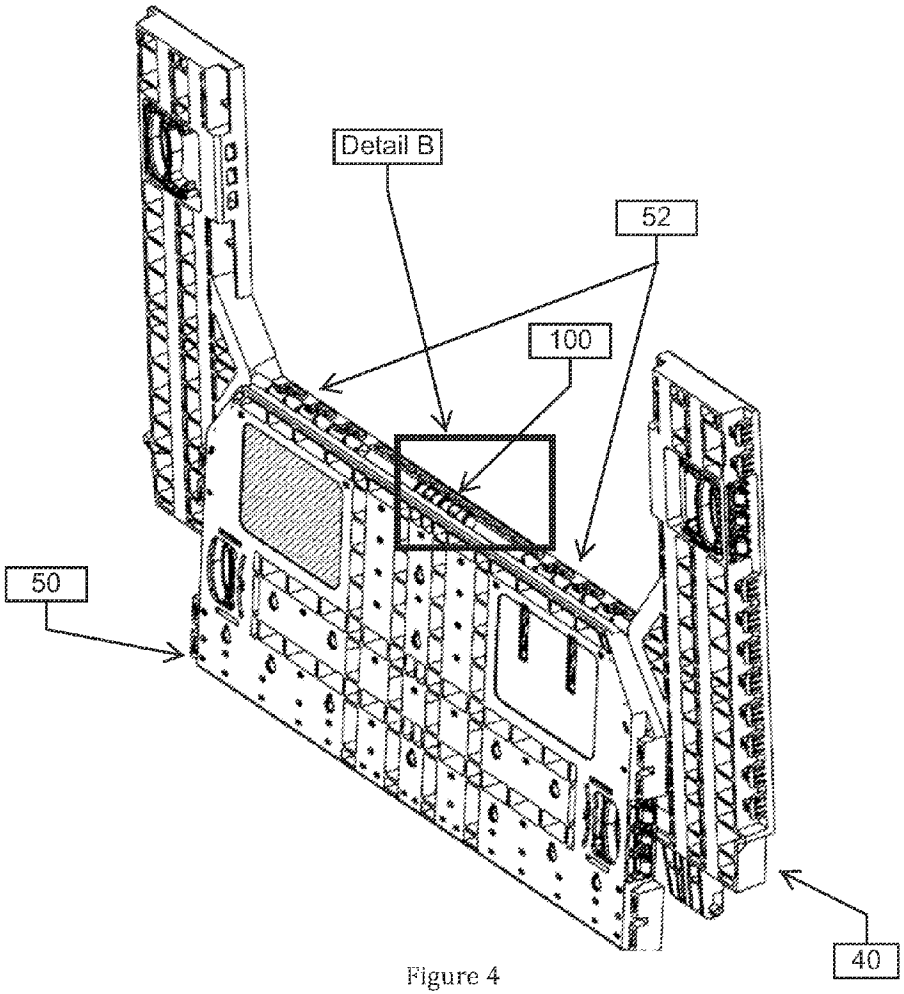
FIG. 4 is a perspective view of a sidewall from the embodiment shown in FIG. 1 including the drop down door in a lowered position and the safety catch.
Figure 5:
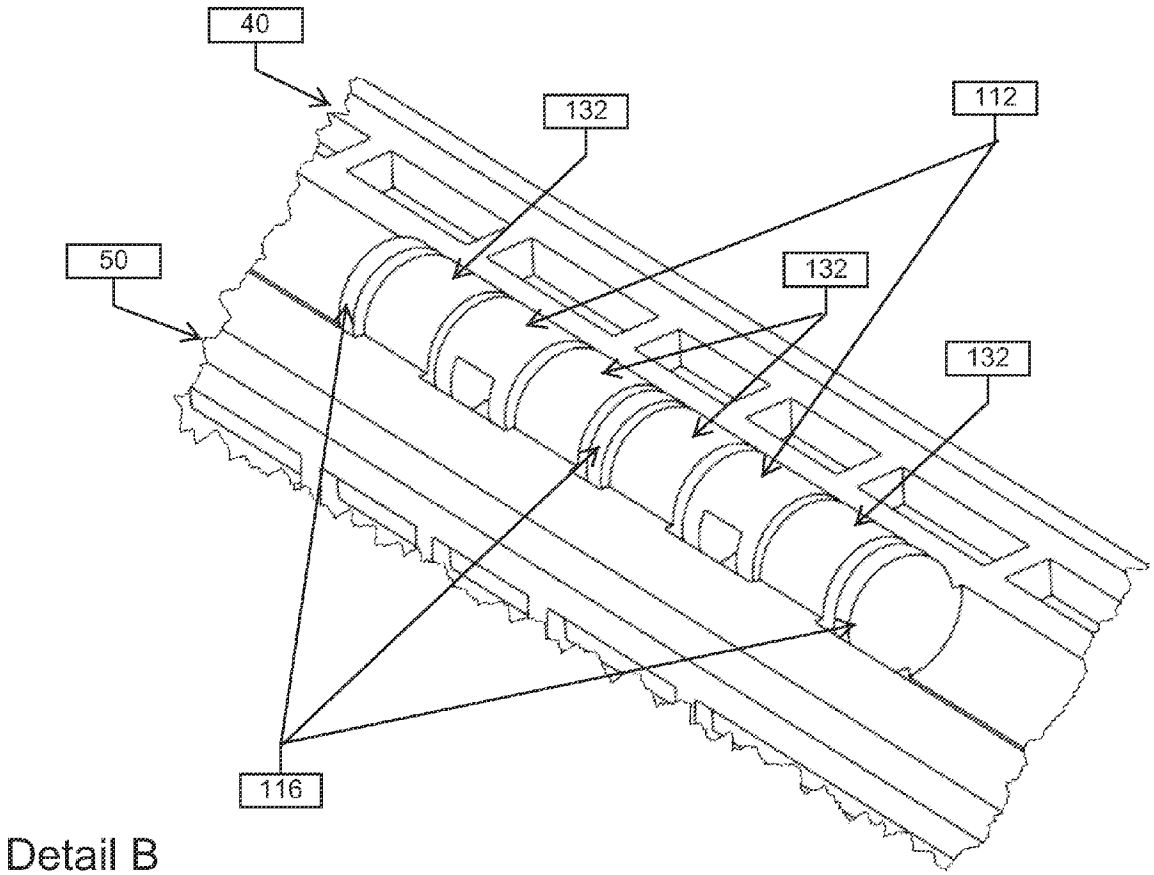
FIG. 5 is a detail perspective view of the embodiment from FIG. 4 showing the safety catch with the drop down door in a lowered position.
Figure 6:
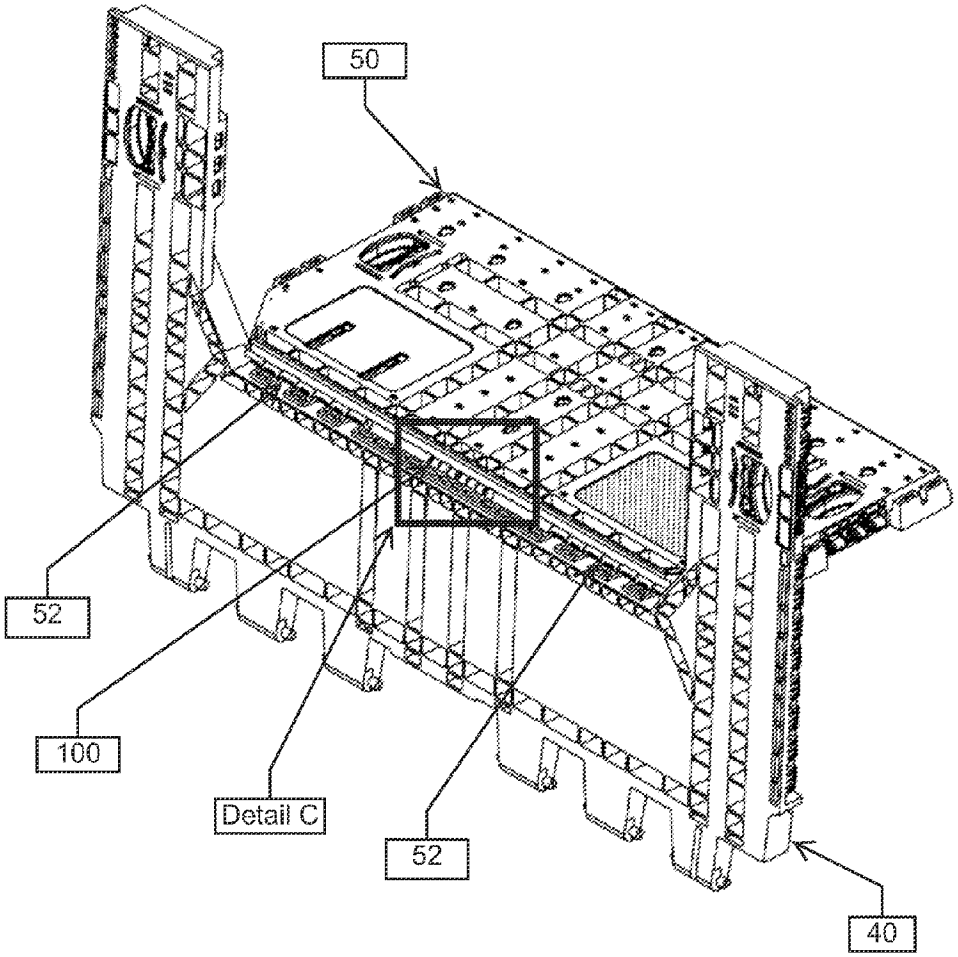
FIG. 6 is a perspective view of a sidewall from the embodiment shown in FIG. 1 including the drop down door in a partially lowered position and the safety catch.
Figure 7:
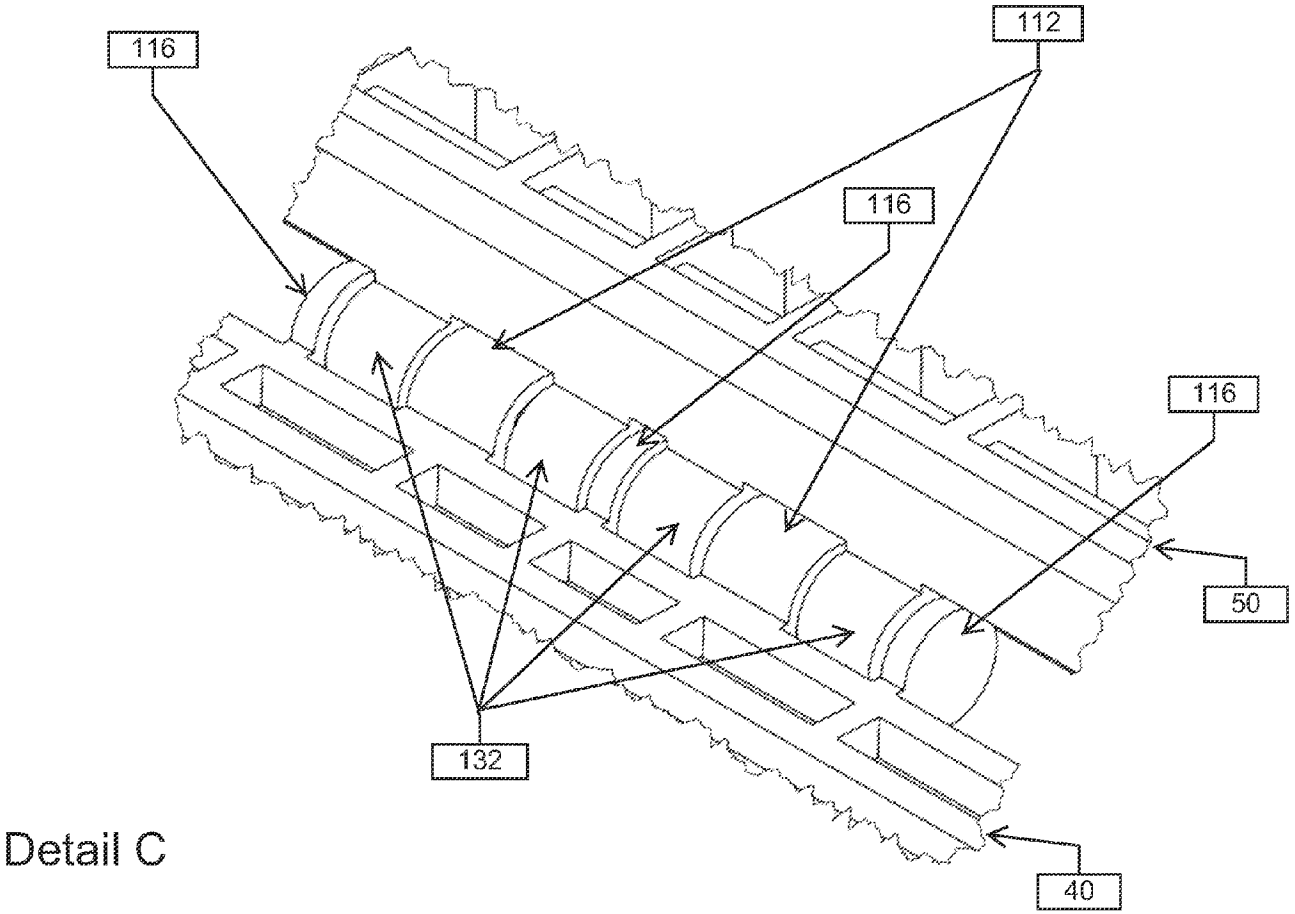
FIG. 7 is a detail perspective vim of the embodiment from FIG. 6 showing the safety catch with the drop down door a partially lowered position.
Figure 8:
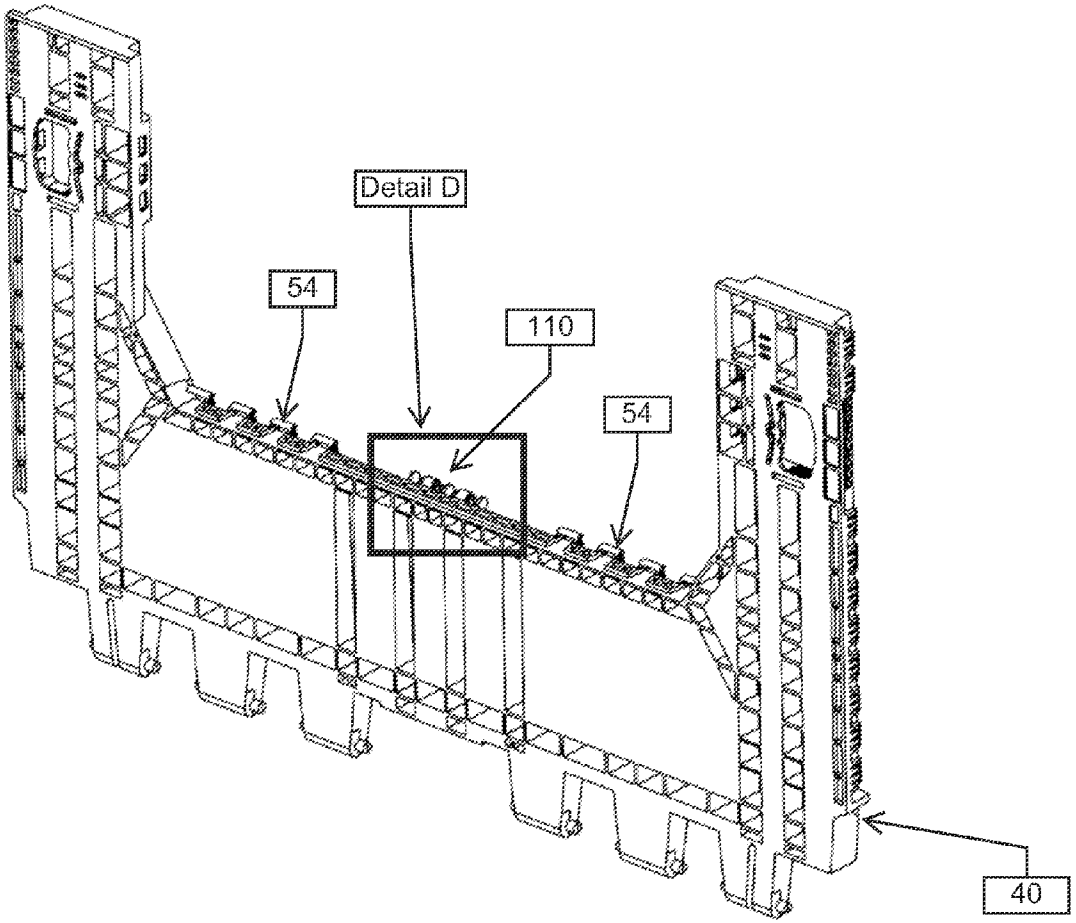
FIG. 8 is a perspective view of a sidewall from the embodiment shown in FIG. 1 with the drop down door removed and including the sidewall portion of the safety catch.

The present invention is a shipping container for bulk goods. Container 1 comprises rectangular base, sidewalls 40, and one or more door 50. Door 50 is hinged at its bottom to allow easy access to the goods contained in container 1, and known container designs use many known hinge designs. In the illustrated embodiment of container 1, door 50 includes two hinges 52. Each hinge 52 comprises alternating knuckles 54 that are formed integrally with sidewall 40 and door 50. A hinge pin is inserted through alternating knuckles 54 to rotatably affix door 50 to sidewall 40. Door 50 also includes latches to affix door 50 in its upright position.

As discussed above, hinges used with drop downs doors on containers are a frequent failure point. Examples of such failures include, missing hinge pins (which can result from an assembly error or due to vibration during transportation), broken knuckles, and, in the case of non-integral hinges, the failure of the connection of hinges 52 to sidewall 40 or to door 50. Such failures are problematic because, as discussed above, even if the hinge or hinges have failed, the door will remain in its upright position due to latches 58 and the fact that the lower portion of door 50 rests on sidewall 40. Thus, if there is an undetected hinge failure, when an operator releases latches 58 and allows door 50 to freely rotate toward is open position, door 50 may separate from container 1 and fall freely to the floor, often causing foot or toe injuries to the operator.

To address this issue, container 1 further comprises safety catch 100. Safety catch 100 is configured to allow door 50 to freely rotate on hinges 52 while bearing no load (though safety catch 100 may bear some hydraulic load when door 50 is in its upright position and container 1 is loaded). Safety catch 100 also avoids the issues that arise with the use of a tethered restraint system. Safety catch 100 comprises sidewall portion 110, which is interconnected with or integral to sidewall 40 and door portion 130 that is interconnected with or integral to door 50.

Figure 9:
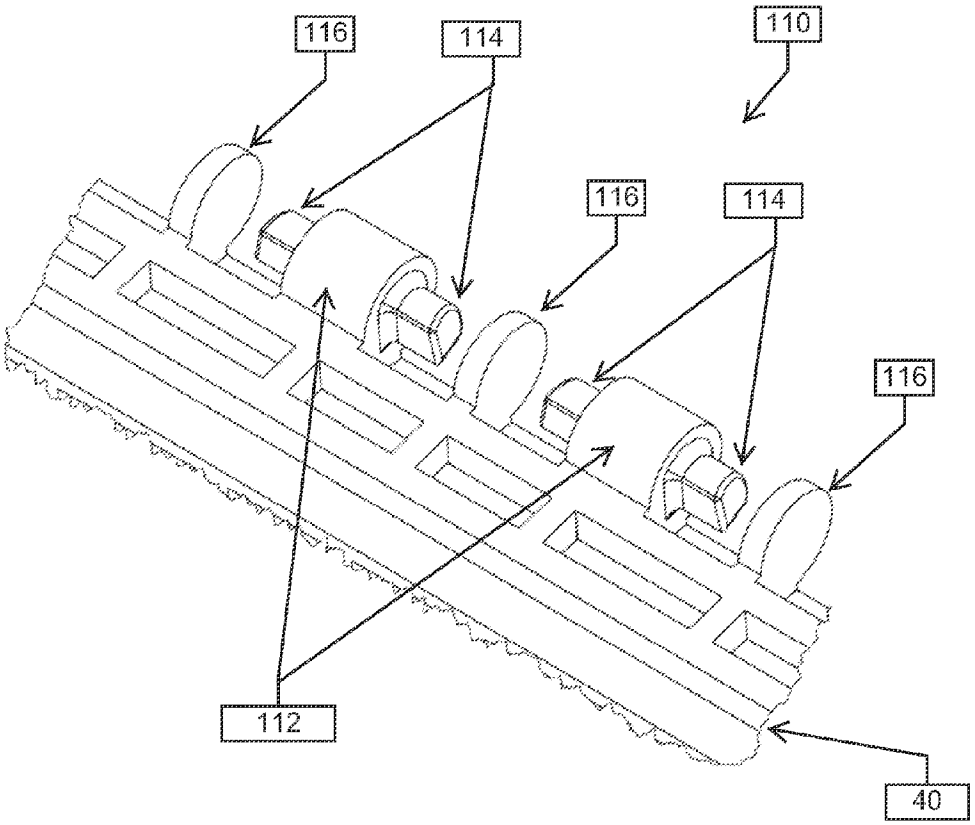
FIG. 9 is a detail perspective view of the embodiment from FIG. 8 showing the sidewall portion of the safety catch with the drop down door removed.
Figure 10:
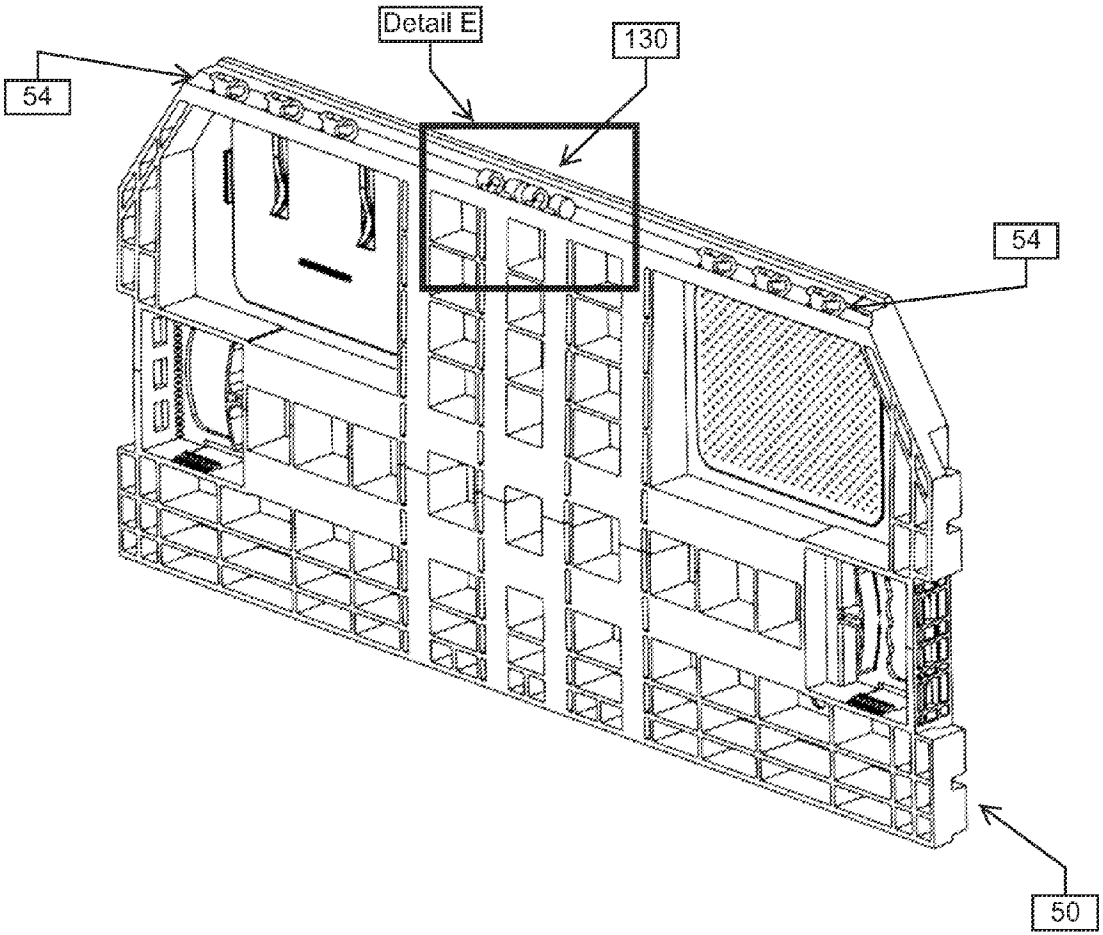
FIG. 10 is a perspective view of the drop down door from the embodiment shown in FIG. 1 including the door portion of the safety catch.

Sidewall portion 110 of safety catch 100 (best seen in FIG. 9) comprises at least one post 112 extending from sidewall 40. Extending outward from each side of post 112 are pins 114. Spaced apart from the end portions of pins 114 are retention walls 116 that extend from sidewall 40. In the illustrated embodiment, sidewall portion 110 comprises two posts 112. In this configuration, a single retention wall 116 is provided between the adjacent pins 114 of the two posts 112. Depending on the application, still more posts 112 may be provided, with only a single retention wall 116 provided between adjacent pins 114 of adjacent posts 112.

Door portion 130 of safety catch 100 (best seen in FIG. 11) comprises a pair of opposing housings 132 for each post 112 provided in the sidewall portion of safety catch 100. Each housing 132 extends from the lower portion of door 50. Each housing 132 further comprises rear wall 134. Each rear wall 134 has a thickness of no more than the distance between retention wall 116 and pin 114, and rear walls 134 of a pair of opposing housings 132 are spaced apart to allow rear walls 134 to be simultaneously inserted into the gap between the retentions walls 116 and pins 114 associated with post 112 of the sidewall portion of 110 of safety catch 100.

Figure 11:
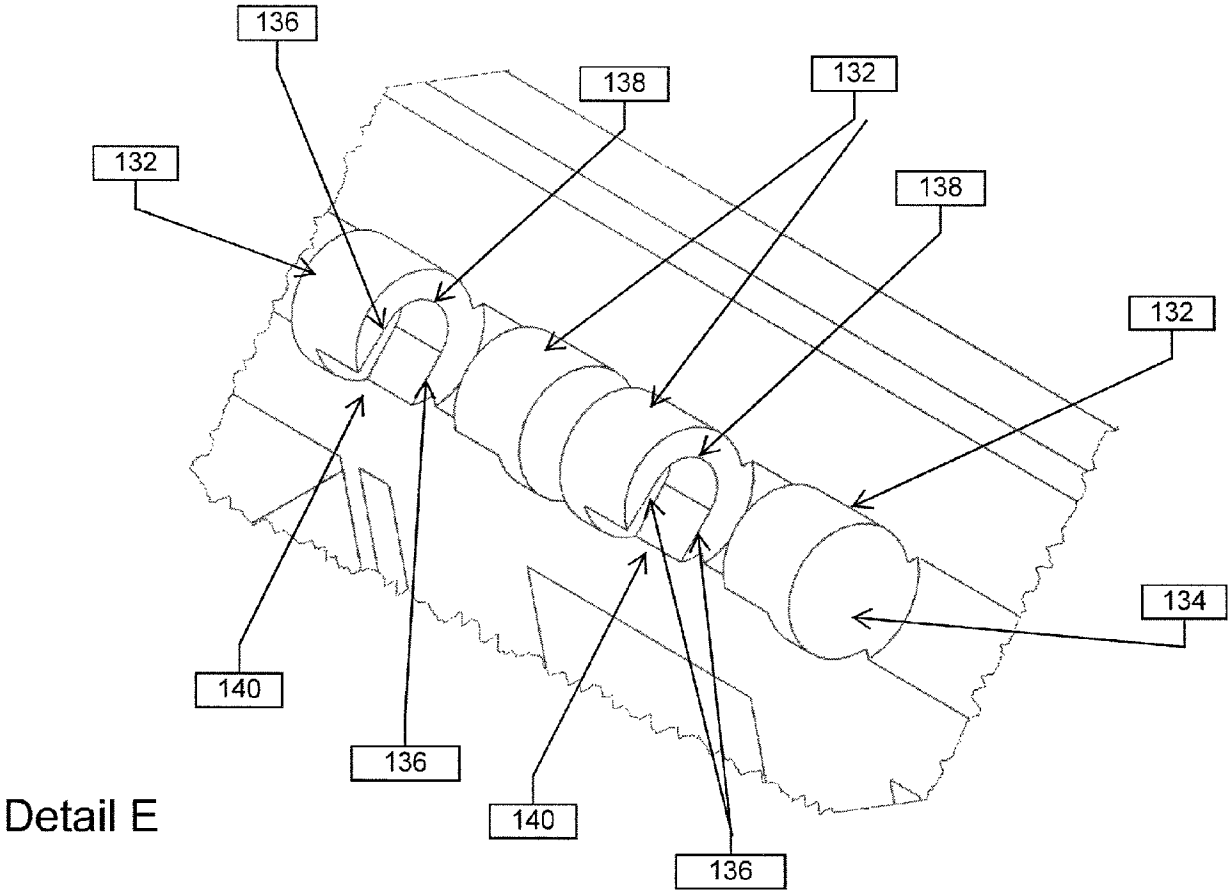
FIG. 11 is a detail perspective view of the embodiment from FIG. 10 showing the door portion of the safety catch on the drop down door.

Extending from rear wall 134 are parallel walls 136, which are spaced apart the diameter of pin 114 to form slot 140 to receive pin 114. The closed end of slot 140 is formed by semi-circular wall 138. This configuration is best seen in FIG. 11. Parallel walls 136 and semi-circular wall 138 extend from rear wall 134 a distance that is no greater than the length of pin 114. Parallel walls 136 are oriented at an angle downward from semi-circular wall 138 when door 50 is oriented vertically with its hinge side up. This facilitates installation of door 50 to sidewall 40 and ensures that door portion 130 of safety catch 100 will not come disengaged from sidewall portion 110 when door 50 is allowed to rotate to its open position and hinges 52 have failed. Door 50 is further prevented from sliding off laterally by rear walls 134 of housings 132, each of which is positioned between a retention wall 116 and the end of a pin 114.

Once safety catch 100 is engaged, door 50 is further connected to sidewall 40 using hinges 52. In the event of a failure of hinges 52, safety catch 100 will ensure that door 50 will remain attached to sidewall 40 when door 50 is unlatched and allowed to freely rotate to its open position.

The foregoing described embodiments are exemplary in nature and are not intended to limit the scope of the invention.

I claim:

1. A safety catch for an access door in the sidewall of a shipping container that is horizontally hinged at its bottom comprising:

a sidewall portion, said sidewall portion further comprising:

a post extending from the sidewall adjacent a lower portion of the door, a pair of pins extending outward from said post, and a pair of retention walls extending from said sidewall, each said retention wall being spaced apart from the outward end of one of the pins;

a plurality of posts extending from the sidewall;

a pair of pins extending outward from each said post such that at least one pin extending from each of the plurality of posts extends toward one of the pins extending from an adjacent post of said plurality of posts, there being a gap defined between the ends of said pins extending toward each other;

a plurality of retention walls extending from the sidewall parallel to said posts, wherein one of said plurality of retention walls is located intermediate to and spaced apart from each pair of facing pins and one of said plurality of retention walls is located outside of each of the terminal posts in the plurality of posts such that one of said plurality of retention walls is spaced apart from each of the pins that extend away from each the plurality of posts;

a door portion, said door portion comprising a pair of housings extending from the door, each housing further comprising a slot to engage one of said pins;

a door portion, said door portion further comprising a plurality of paired housings, each pair of housings extending from the door and spaced apart such that each pair of housings can receive the pins of one of the plurality of posts;

wherein each housing of said plurality of paired housings further comprises:

a rear wall wherein the thickness of the rear wall of each housing is less than the spacing between each of said plurality of retention walls and the pins extending from each of said plurality of posts;

a pair of parallel walls extending from said rear wall;

a semi-circular wall extending from said rear wall and connecting adjacent ends of said parallel walls;

said parallel walls and said semi-circular wall cooperating to form a slot for receiving one of said pins extending from one of said posts;

wherein the parallel walls are oriented at an acute downward angle when the door is oriented vertically with its hinge side up.

2. A shipping container comprising:

at least one sidewall;

a door;

at least one hinge, said at least one hinge connecting a bottom portion of the door to sidewall such that said door can be rotated from an upright, closed position, to an open position wherein said door hangs down from said at least one hinge and said door is adjacent to a portion of the exterior of the sidewall below said at least one hinge;

a safety catch, said safety catch comprising:

a sidewall portion, said sidewall portion further comprising:

a plurality of posts extending from the sidewall;

a pair of pins extending outward from each said post such that at least one pin extending from each of the plurality of posts extends toward one of the pins extending from an adjacent post of said plurality of posts, there being a gap between the ends of said pins extending toward each other;

a plurality of retention walls extending from the sidewall parallel to said posts, wherein one of said plurality of retention walls is located intermediate to and spaced apart from each pair of facing pins and one of said plurality of retention walls is located outside of each of the terminal posts in the plurality of posts such that one of said plurality of retention walls is spaced apart from the pin of each of the terminal posts that extends away from the plurality of posts;

a door portion, said door portion further comprising a plurality of paired housings, each pair of housings extending from the door and spaced apart such that each pair of housings can receive the pins of one of the plurality of posts;

wherein each housing of said plurality of paired housings further comprises:

a rear wall wherein the thickness of the rear wall of each housing is less than the spacing between each of said plurality of retention walls and the pins extending from each of said plurality of posts;

a pair of parallel walls extending from said rear wall;

a semi-circular wall extending from said rear wall and connecting adjacent ends of said parallel walls;

said parallel walls and said semi-circular wall cooperating to form a slot for receiving one of said pins extending from one of said posts;

wherein the parallel walls are oriented at an acute downward angle when the door is oriented vertically with its hinge side up.

* * * * *